US006502547B2

(12) United States Patent
Kennedy et al.

(10) Patent No.: US 6,502,547 B2
(45) Date of Patent: Jan. 7, 2003

(54) FOAMED OVER INTEGRATED CIRCUIT FOR INTAKE MANIFOLD

(75) Inventors: Gary Irwin Kennedy, Tecumseh (CA); Erik Kristian Karell, Commerce Township, MI (US); Jon-David Kehoe, Tilbury (CA)

(73) Assignee: Siemens VDO Automotive Inc., Tilbury (CA)

( * ) Notice: Subject to any disclaimer, the term of this patent is extended or adjusted under 35 U.S.C. 154(b) by 59 days.

(21) Appl. No.: 09/769,791

(22) Filed: Jan. 25, 2001

(65) Prior Publication Data

US 2001/0032614 A1 Oct. 25, 2001

Related U.S. Application Data

(60) Provisional application No. 60/178,642, filed on Jan. 28, 2000.

(51) Int. Cl.[7] ..... F02D 11/10

(52) U.S. Cl. ..... 123/399; 123/472; 123/184.61; 123/143 C; 307/9.1

(58) Field of Search ..... 123/399, 143 C, 123/647, 472, 184.61; 307/10.6, 10.8, 9.1; 174/72 A, 255, 256, 258, 259, 260; 361/760, 767, 771; 439/34, 127

(56) References Cited

U.S. PATENT DOCUMENTS

| | | | | |
|---|---|---|---|---|
| 3,631,297 A | * | 12/1971 | Conner | 174/255 |
| 4,756,283 A | * | 7/1988 | Kleinbohl | 123/143 C |
| 4,869,670 A | | 9/1989 | Ueda et al. | 439/34 |
| 5,349,930 A | * | 9/1994 | Maruyama et al. | 123/143 C |
| 5,390,648 A | | 2/1995 | Yanase | 123/634 |
| 5,743,235 A | * | 4/1998 | Lueder | 123/143 C |
| 5,856,777 A | * | 1/1999 | Rullman et al. | 307/10.8 |
| 5,917,151 A | | 6/1999 | O'Brien et al. | |
| 5,973,265 A | | 10/1999 | O'Brien et al. | |
| 6,011,318 A | | 1/2000 | Mayoras et al. | |
| 6,027,679 A | | 2/2000 | O'Brien et al. | |
| 6,071,446 A | | 6/2000 | O'Brien et al. | |
| 6,086,037 A | | 7/2000 | Nagy et al. | |
| 6,107,569 A | | 8/2000 | Shields et al. | |
| 6,120,327 A | | 9/2000 | O'Brien et al. | |
| 6,126,228 A | | 10/2000 | Davis, Jr. et al. | |
| 6,161,889 A | | 12/2000 | Davis, Jr. et al. | |
| 6,186,106 B1 | * | 2/2001 | Glovatsky et al. | 123/143 C |

FOREIGN PATENT DOCUMENTS

| | | |
|---|---|---|
| DE | 2823666 A1 | 12/1979 |
| DE | 019842041 A1 | 3/1999 |
| EP | 0872384 A2 | 10/1998 |
| EP | 0872384 A3 | 10/1998 |
| EP | 0932234 A1 | 12/1998 |
| JP | 05114310 | 5/1993 |

OTHER PUBLICATIONS

European Search Report completed Feb. 7, 2002.

* cited by examiner

*Primary Examiner*—Willis R. Wolfe

(57) ABSTRACT

The vehicle engine electrical system comprises a vehicle engine component such as an air intake manifold, at least one conductor, and foam mounting the conductor to the vehicle engine component. The conductor may be connected to a connector and thereby connected to electrical components of the vehicle such as a fuel injector, sensors, or a controller. The conductor is preferably a flex cable while the foam may be plastic.

20 Claims, 3 Drawing Sheets

FOAMED OVER INTEGRATED CIRCUIT FOR INTAKE MANIFOLD

This application claims priority to Provisional Patent Application Serial No. 60/178,642, filed Jan. 28, 2000.

BACKGROUND OF THE INVENTION

This invention relates to an integrated circuit for an air intake manifold and a method of manufacturing such a device.

An air intake manifold distributes air to a vehicle engine's cylinders. The manifold is generally located over the engine in the engine compartment of a vehicle such as an automobile. As a consequence, the manifold is in close proximity to various electrical components of the vehicle engine such as fuel injectors, the electric throttle body, throttle position sensors, idle air controller, and air temperature and pressure sensors.

In the past, electric wire harnesses have been used to conduct electricity to and from these electrical components. These wire harnesses are expensive to manufacture and assemble on the vehicle engine. They further are bulky and open to damage from abrasives in the vehicle engine's environment such as heat and chemicals.

Recently, due to the increased use of plastic in the manufacture of an air intake manifold and its proximity to these electrical components, manufacturers investigated or attempted integrating wire into the plastic air intake manifold. The wire itself is embedded into the plastic body of the manifold during the molding process. While the plastic of the manifold protects the wiring from the engine compartment's hostile environment and provides support and mounting for the harness, this product and method of manufacture is undesirable in several respects. In particular, manufacturers have difficulty controlling the location of the wiring while molding the plastic manifold. As a consequence, there is a greater chance of making a part with defective wiring. Scrap rates are thereby increased.

Moreover, manufacturers have greater difficulty recycling the plastic manifold because of the embedded metal in the manifold. If the manifold is recycled, the wiring within the manifold must be removed prior to reclaiming the plastic. This problem not only increases the cost of producing such a manifold but also makes recycling old manifolds cost prohibitive.

A need therefore exists for an air intake manifold with an integrated wiring system but without the foregoing production and recycling problems.

SUMMARY OF THE INVENTION

In a disclosed embodiment, the invention comprises a vehicle engine component with at least one conductor and foam mounting the conductor to the vehicle engine component. The vehicle engine component is preferably an air intake manifold.

The invention further may include an electrical connector that connects the conductor to the electric system of the vehicle engine. The connector may connect to a controller, such as an engine control unit, an engine sensor like an air temperature gauge or a pressure sensor, an electric throttle body and related components, or a fuel injector. The conductor is preferably a flex cable while the foam used to mount the conductor is preferably plastic.

The invention is manufactured very simply. A vehicle engine component is wired as desired and foam in fluid form is injected onto the engine component and the wiring. As the foam dries, it locks the location of the wiring and creates a protective shell for the wiring from the engine's hostile environment.

Because the wiring is set prior to foaming, this method of manufacture avoids the problem of attempting to control the location of the wiring during the molding process. The plastic of the vehicle engine component remains recyclable because the wiring is no longer embedded in the plastic itself. In this way, the benefits of an integrated air intake manifold and circuit are realized at a significantly lower production cost.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1A:
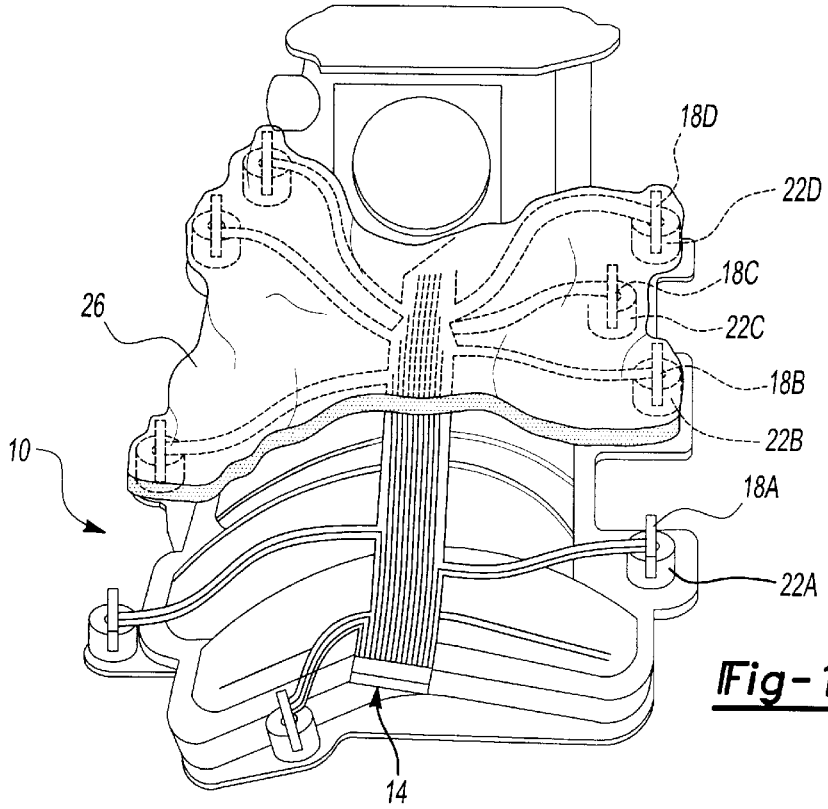
FIG. 1A shows an embodiment of the invention including an air intake manifold, conductor, and supporting foam.

FIG. 1A illustrates an embodiment of the invention. Vehicle engine component 10, here an air intake manifold, is shown with conductor 14 straddling vehicle engine component 10. The component 10 is preferably a molded plastic manifold as known. Conductor 14 has at least one connector (18A, 18B, 18C, or 18D) that serves to connect conductor 14 to various electrical elements of the vehicle engine. In this illustration, connectors 18 A, B, C and D connect conductor 14 to fuel injectors 22 A, B, C and D. Conductor 14 is preferably a flex cable made up of separate conducting pathways.

Foam 26, preferably a plastic or more specifically urethane gasket material mixed with nitrogen, is sprayed or distributed in fluid form onto both conductor 14 and vehicle engine component 10. A mold may be used to shape and better control the dimensions of foam 26. As foam 26 dries and hardens, it provides both a protective layer against the hostile environment of the engine compartment and bonds conductor 14 to vehicle engine component 10. In this way, the conductor is locked in position and mounted to the vehicle engine body, providing a protective covering and support for conductor 14. Moreover, in contrast to a vehicle engine component with wire embedded in the component, foam 26 permits easy removal of conductor 14 to allow the plastic of the vehicle engine component to be recycled.

Figure 1B:
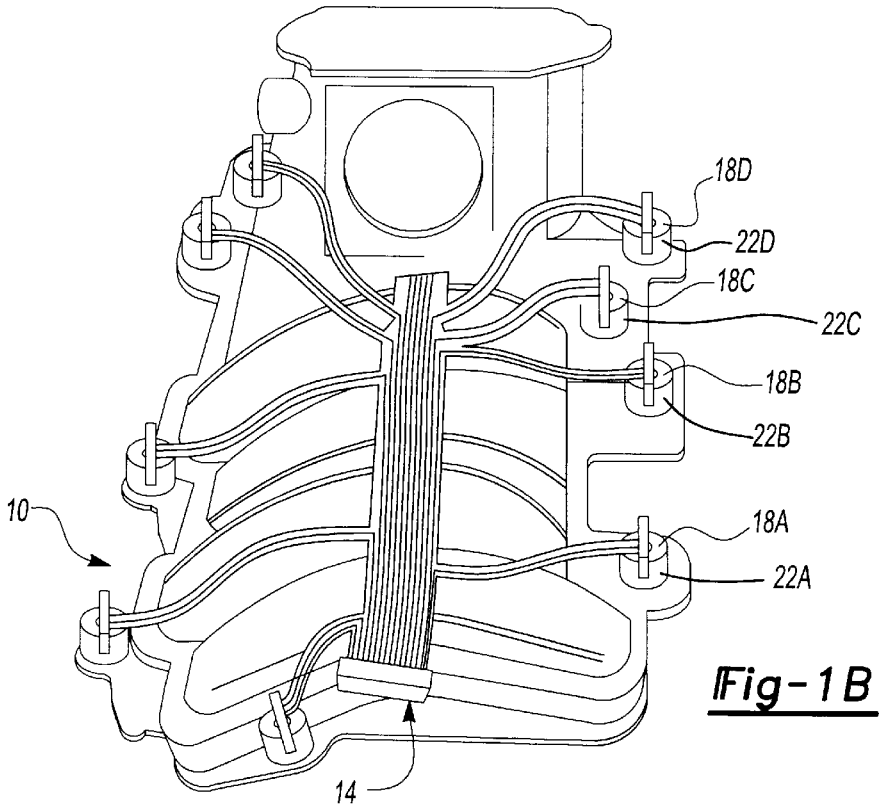
FIG. 1B shows the embodiment of FIG. 1 without foam.
Figure 2:
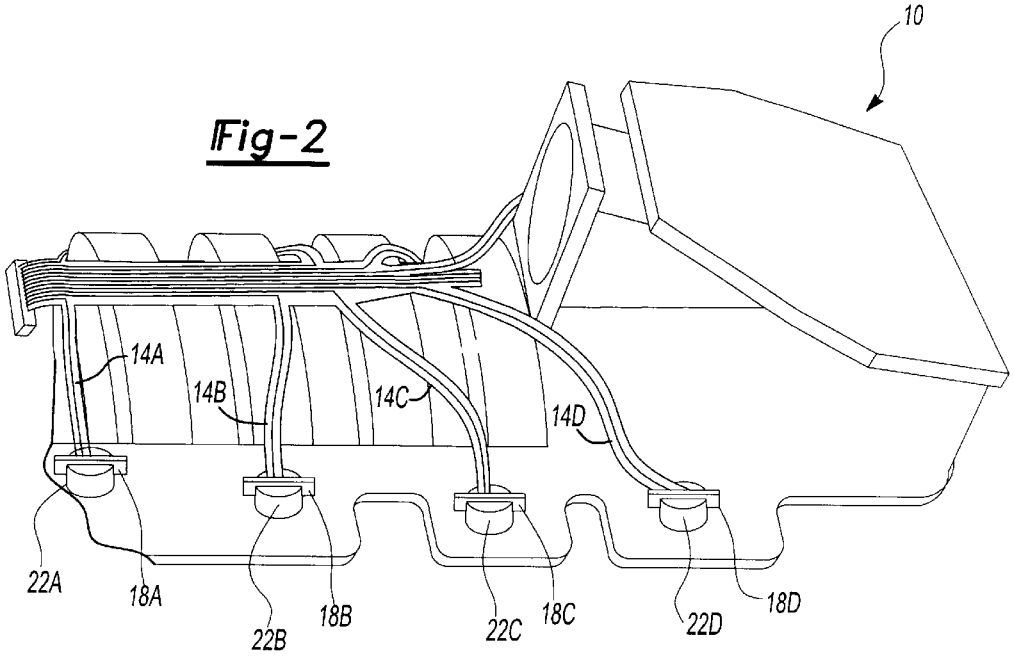
FIG. 2 shows a side view of the embodiment of FIG. 1 without foam.

FIG. 1B shows the layout of conductor 14 of FIG. 1A without foam 26. As seen in this figure, conductor 14 is a flex cable with separate wire pathways as illustrated by 14A, 14B, 14C and 14D. Each pathway (14A, 14B, 14C and 14D) leads to a separate fuel injector or other electrical element. FIG. 2 illustrates a side view of the embodiment of FIG. 1A and 1B, showing more clearly the location of fuel injectors 22A, 22B, 22C and 22D in relation to conductor 14 and separate pathways 14A, 14B, 14C, and 14D on vehicle engine component 10, an air intake manifold.

Figure 3:
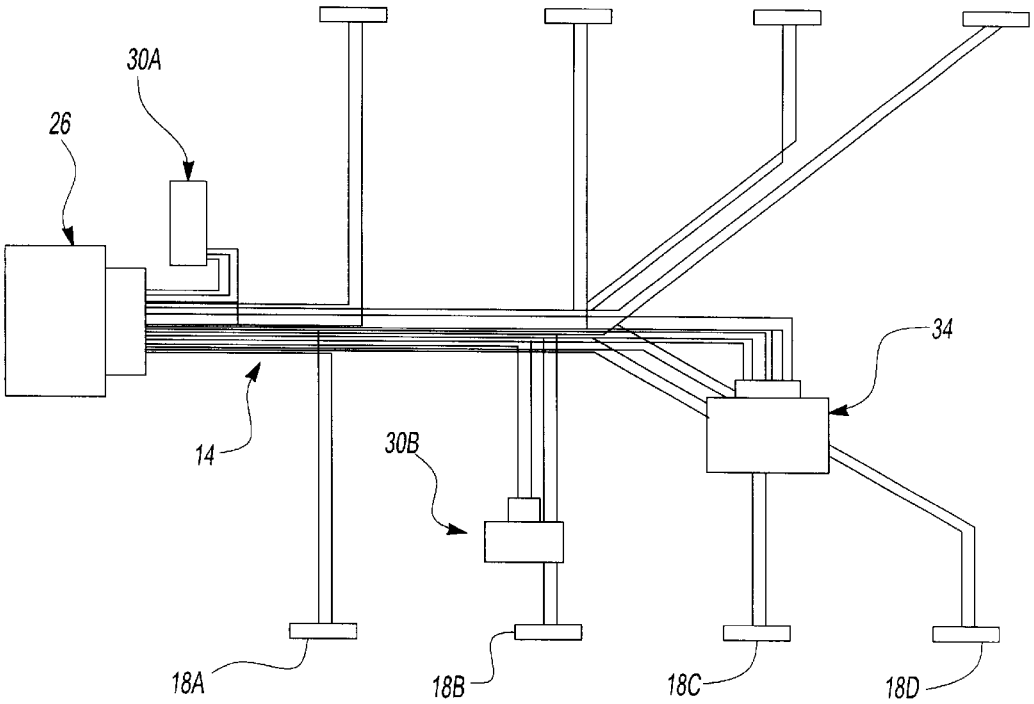
FIG. 3 shows a schematic layout of the embodiment of FIG. 1.
Figure 4:
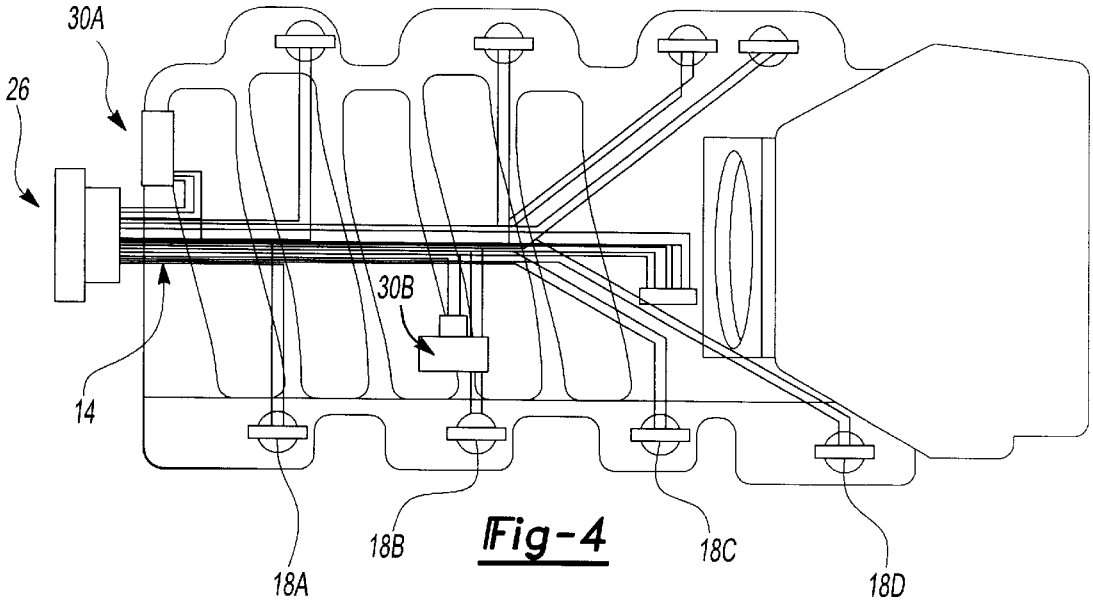
FIG. 4 shows an overhead view of the embodiment of FIG. 1.
Figure 5:
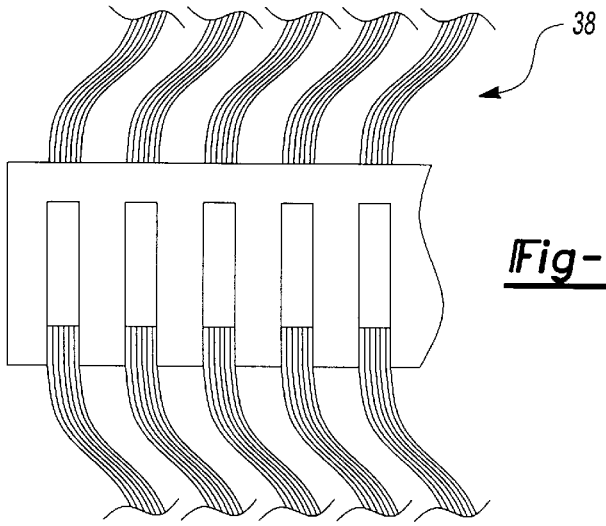
FIG. 5 shows a sample connector of the embodiment of FIG. 1.

FIG. 3 shows a schematic view of the layout of conductor 14. Connectors 18 A–D are also illustrated. Connectors 18A–D connect fuel injectors 22 to conductor 14, and ultimately controller 26. Controller 26 is also connected to sensors 30A and 30B. 30A is a pressure sensor while 30B is an air temperature sensor. Also feeding into conductor 14 is an electrical signal from throttle body 34 through connector 18C. FIG. 4 illustrates this schematic layout on vehicle engine component 10 while FIG. 5 illustrates a sample connector 38 that may be used.

Pathways are preferably capable of handling the current and voltage they must conduct for the sensor, controller, or fuel injector. Typically, fuel injectors will have a maximum current of 1000 mA and a maximum voltage of 12 V. A two pin connector will usually be required. A pressure sensor will have a maximum current of about 10 mA and a maximum voltage of 5 V and likely require a three pin connector. An air temperature sensor typically should be rated for about 15 mA, 5V, and have two pins. A throttle position sensor should be capable of handling about 15 mA current, 5 V, and have a three pin connector while an idle air control unit will generally require the handling of a maximum current of 250 mA, 12 V, and have four pins.

Additionally, the conductor and materials used will typically encounter a temperature range of −40° F. to 260° F. and should be able to withstand this range as well as thermal shocking and cycling. Moreover, in addition to this range, the conductor and materials employed should be able to handle vibration of up to 10 g Rms and also be resistant to salt water, gasoline, oil, antifreeze, lubricants, brake fluids and other commonly encountered chemicals.

The aforementioned description is exemplary rather then limiting. Many modifications and variations of the present invention are possible in light of the above teachings. The preferred embodiments of this invention have been disclosed. However, one of ordinary skill in the art would recognize that certain modifications would come within the scope of this invention. Hence, within the scope of the appended claims, the invention may be practiced otherwise than as specifically described. For this reason the following claims should be studied to determine the true scope and content of this invention.

What is claimed is:

1. A vehicle engine electrical system comprising;

a vehicle engine component;

at least one conductor; and foam mounting said conductor to said vehicle component.

2. The vehicle engine electrical system of claim 1 wherein said vehicle engine component is an air intake manifold.

3. The vehicle engine electrical system of claim 1 wherein said foam is plastic.

4. The vehicle engine electrical system of claim 1 wherein said at least one conductor is at least one flex cable.

5. The vehicle engine electrical system of claim 1 further comprising at least one connector operatively connected to said at least one conductor.

6. The vehicle engine electrical system of claim 5 further comprising at least one controller operatively connected to said connector.

7. The vehicle engine electrical system of claim 5 further comprising an electric throttle body operatively connected to said connector.

8. The vehicle engine electrical system of claim 5 further comprising at least one fuel injector operatively connected to said connector.

9. The vehicle engine electrical system of claim 5 further comprising at least one sensor operatively connected to said connector.

10. The vehicle engine electrical system of claim 9 wherein said sensor is an air temperature sensor.

11. The vehicle engine electrical system of claim 9 wherein said sensor is a pressure sensor.

12. A method of manufacturing a vehicle engine electrical system comprising the steps of:

providing a vehicle engine component;

providing at least one conductor; and using a foam to mount the at least one conductor on the vehicle component.

13. The method of claim 12 wherein the vehicle engine component is an air intake manifold.

14. The method of claim 12 wherein the foam is plastic.

15. The method of claim 12 wherein the conductor is at least one flex cable.

16. The method of claim 12 further comprising the step of operatively connecting at least one connector to the conductor.

17. The method of claim 16 further comprising the step of operatively connecting the connector to a controller.

18. The method of claim 16 further comprising the step of operatively connecting the connector to a sensor.

19. The method of claim 16 further comprising the step of operatively connecting the connector to an electric throttle body.

20. The method of claim 16 further comprising the step of operatively connecting the connector to a fuel injector.

* * * * *